United States Patent [19]

Petrov et al.

[11] 4,264,405

[45] Apr. 28, 1981

[54] APPARATUS FOR THE MECHANICAL SEPARATION OF CATHODE METAL FROM A MATRIX

[75] Inventors: Peter I. Petrov; Ivan D. Enchev; Kiril G. Harisanov; Georgi N. Korudanov; Georgi I. Abrashev; Lyuben R. Starev, all of Plovdiv, Bulgaria

[73] Assignee: Institute po Tzvetna Metalurgia, Plovdia, Bulgaria

[21] Appl. No.: 139,694

[22] Filed: Apr. 11, 1980

[51] Int. Cl.[3] ..... B32B 31/16

[52] U.S. Cl. ..... 156/584; 156/344; 204/12; 204/198; 204/281; 269/21; 294/64 R; 427/350

[58] Field of Search ..... 156/344, 584; 204/12, 204/208, 225, 226, 281, 198; 269/21; 279/3; 294/64 R; 427/350

[56] References Cited

U.S. PATENT DOCUMENTS

| | | | |
|---|---|---|---|
| 3,625,806 | 12/1971 | Wennberg | 156/584 |
| 3,865,420 | 2/1975 | Warren | 294/64 R |
| 3,913,964 | 10/1975 | Lukeman | 294/64 R |
| 3,935,091 | 1/1976 | Rautimo et al. | 204/281 |
| 3,980,548 | 9/1976 | Sekine et al. | 204/281 |
| 3,996,127 | 12/1976 | Rautimo et al. | 204/281 |
| 4,209,379 | 6/1980 | Freeman et al. | 204/281 X |

*Primary Examiner*—John T. Goolkasian
*Assistant Examiner*—Robert A. Dawson
*Attorney, Agent, or Firm*—Klein & Vibber

[57] ABSTRACT

Apparatus for mechanically separating cathode metal such as zinc from a matrix during electroextraction of the metal. The matrix with layers of cathode metal on both sides thereof is supported on a frame and positioned by guides. Vacuum heads are advanced towards each other and brought into sealing contact with the layers of cathode metal on the opposite sides of the matrix. Following this, the vacuum heads are subjected to reduced pressure so that the heads effect seals with the cathode metal layers, and then the vacuum heads are pulled apart to strip the layers of cathode metal from the matrix.

4 Claims, 1 Drawing Figure

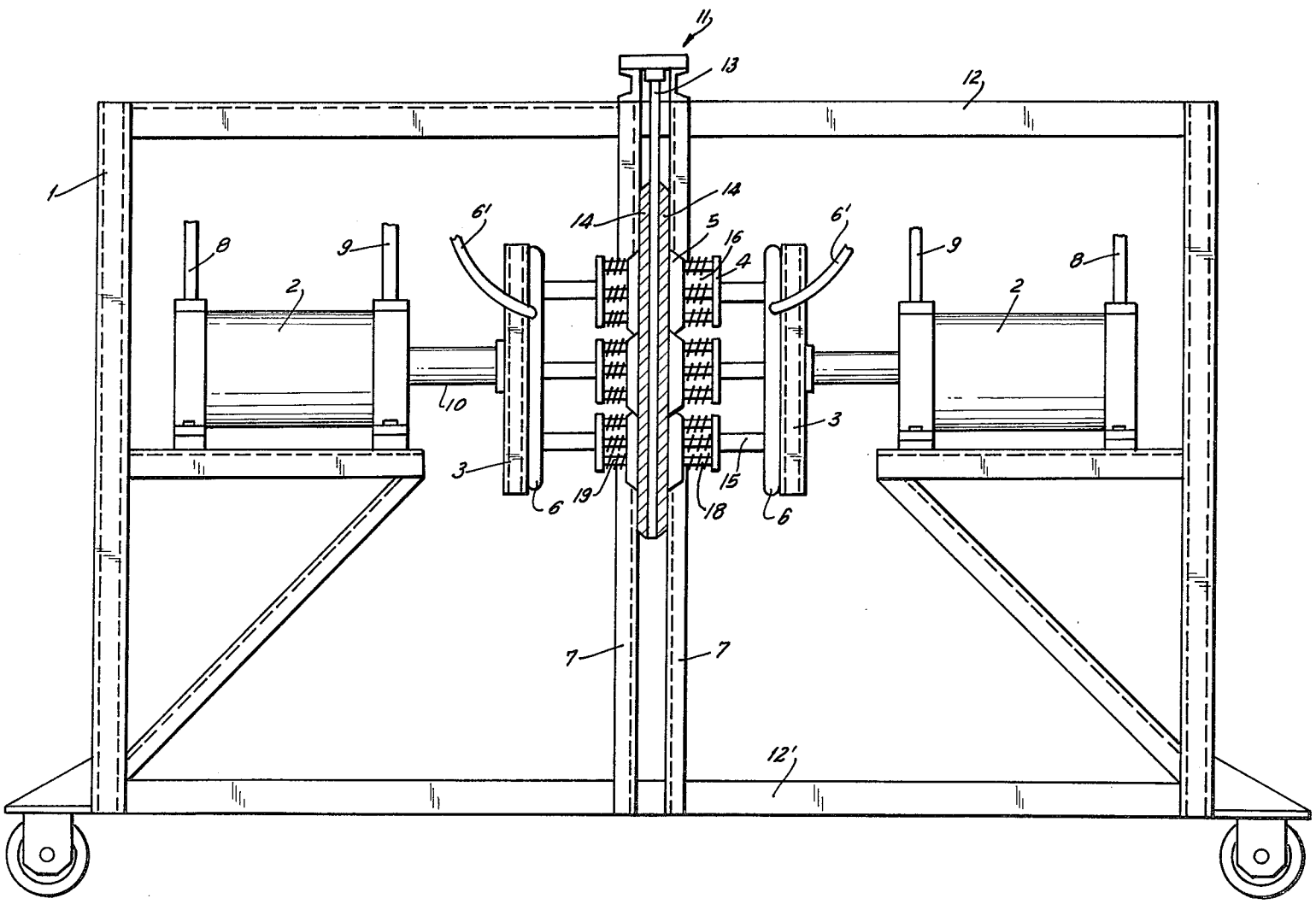
1
2
2
3
3
4
5
6
6
6'
6'
7
7
8
8
9
9
10
11
12
12'
13
14
14
15
16
18
19

APPARATUS FOR THE MECHANICAL SEPARATION OF CATHODE METAL FROM A MATRIX

The invention relates to an apparatus for the mechanical separation of cathode metal such as zinc from a matrix during the electroextraction of the metal.

A machine is already known for the mechanical separation of cathode metal from a matrix. Such machine comprises a frame to which the cathode is fixed in a working position after being taken out of the electrolytic bath. At the front part of the frame there are two immovable wedges touching the vertical edges of the matrix. Of the cathode there are also disposed two chisels which are rotated with respect to the matrix. The two wedges separate the front end of the cathode metal sheet from the matrix, following which the chisels are presented between the matrix and the cathode metal sheet to effect the final separation of such sheet from the matrix.

The basic drawbacks of said known machine are its heavy construction, its slow operation, and the shorter effective life of the matrices because of the damage to them caused by the wedges and chisels.

The invention has among its objects the provisions of an apparatus for the mechanical separation of a layered cathode metal such as zinc from a matrix in the process of the electroextraction of such metal, such apparatus having a greater productivity than those of the prior art as well as operating in such manner as to lead to much longer service life of the matrices.

This object is achieved by the apparatus of the invention. In a preferred embodiment of such apparatus there is a frame upon which a coated matrix is hung vertically between vertical guide members which position the matrix. Supported on the frame on opposite sides of the matrix are two aligned fluid actuated reciprocating motors having piston rods disposed normal to the plane of the matrix. Mounted upon the outer free end of each of the piston rods is a platen disposed at right angles to and with its rod surface parallel to the plane of the matrix, each platen bearing a broad manifold to which there are secured a number of vacuum heads each of which has its individual means for effecting a seal with the confronting side of the coating upon the matrix. After the piston rods have been advanced toward the respective sides of the coated matrix to establish seals between its respective vacuum heads and the coating on the matrix, the manifold and the vacuum heads subjected to reduced pressure and the fluid motors are reversed so that the coatings on the opposite sides of the matrix are stripped from it by the respective sets of vacuum heads.

The apparatus of the invention separates electro deposited layers from the matrix by a simple pulling operation which does not subject the matrix to any scraping or gouging by wedges, chisels or the like. It also is compact and simple in construction and is easily and quickly operated so as to have a high rate of production.

The invention will be more readily understood by reference to the drawing, in which:

The single FIGURE of the drawing is a view partially in elevation and partially in vertical longitudinal section.

Turning now to the drawing, the apparatus has a frame 1 made up of upper and lower cross members, 12 and 12' respectively, such cross members being connected by vertical members, as shown.

Between corresponding members 12 and 12' there extend spaced vertical guide members 7 which receive the outer edge of a coated matrix 11 between them while leaving free the broad central areas of the coated matrix. The matrix 11 is made up of a flat aluminum plate 13 which bear layers 14 of electro deposited metal on opposite sides thereof.

Supported on platforms at opposite ends of the frame are aligned opposing fluid operated reciprocating motors each having a cylinder 2 in which there reciprocates a piston (not shown) having a piston rod 10. Motors 2 have fluid conducting conduits 8 and 9 connected to opposite ends thereof, piston rods 10 being extended toward each other by feeding fluid under pressure from a pressure source (not shown) into conduit 8 while exhausting fluid from the motors through the conduits 9. The piston rods 10 are retracted into the cylinders 2 by exhausting fluid from the conduits 8 while feeding pressure fluid into the cylinder through the conduits 9.

A platen 3 is attached to the outer free end of each of the piston rods 10, each platen having a broad vacuum manifold 6 mounted upon its outer end surface. Distributed over the outer transverse surface of each vacuum manifold 6 are a plurality of horizontally extending tubes 15, each tube 15 bearing a can-like head 16 at its outer end. Disposed about the outer end of each vacuum head 16 is an annular resilient seal 5 made of rubber or the like.

After the coated matrix 11 has been positioned as shown, the piston rods 10 with their respective platens 3 and vacuum manifolds 6 are advanced toward each other so that the seals 5 of the vacuum heads 16 are brought forcibly into contact with the outer surfaces with the coatings 14 on the matrix. Each vacuum head 16 is provided with a flange 4 having a plurality of studs 18 projecting therefrom toward the respective seal 5, there being a coil compression spring 19 telescoped over each of studs 18, such springs acting between the flange 4 and the seal 5 of each vacuum head so as to thrust the seal 5 forcibly into sealing engagement with the outer surface with the respective coating 14.

The vacuum manifolds 6 are now subjected to vacuum applied through respective flexible conduits 6' from a vacuum source (not shown). Immediately thereafter the fluid operated motors are reversed by admitting fluid under pressure into the cylinders 2 through the respective conduits 9 while exhausting fluid therefrom through the conduits 8. The piston rods 10 and the platens 3, the vacuum manifold 6, and the vacuum heads 16 are retracted, the vacuum heads 16 pulling the electro deposited coatings 14 on the respective sides of the matrix in opposite directions thereby to strip such coatings from the matrix. After the coatings have been thus stripped from the matrix the vacuum is cut-off from the conduit 6' to allow the stripped coatings to fall free from the vacuum head 16.

The embodiment of the apparatus of the invention herein shown and described is particularly advantageous since the matrix per se is subjected only to equal and opposite tensile forces during the stripping of the coatings 14 from it. This follows from the fact that the fluid operated motors are similar and exert the same but oppositely directed forces along the common axis of the cylinders 2 and the piston rods 10 of the fluid motors. Thus the matrix is not subjected to any torsion or bending moments during the opperation of removing the coatings 14 therefrom, and the guides 7 exert little if any force upon the matrix.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. Apparatus for the mechanical separation from a matrix of a coating of cathode metal electro deposited thereon, comprising means for positioning a coated matrix, and coating separating means including at least one vacuum head having a sealing means thereon, means for presenting the vacuum head and sealing engagement with a surface of the coating on the positioned matrix, means for thereafter subjecting the vacuum head to vacuum thereby to securely attach the vacuum head through its sealing means to the coating, and means thereafter to retract the vacuum head to the matrix to separate the coating therefrom.

2. Apparatus in accordance with claim 1 wherein the matrix has a coating of cathode metal on both sides thereof, and comprising similar but oppositely acting coating separating means including vacuum heads disposed in alignment on opposite sides of the matrix means for simultaneously presenting the vacuum heads of the respective coating separating means to the coatings on the opposite sides of the matrix, and means for simultaneously retracting such vacuum heads from the matrix to separate the coatings therefrom.

3. Apparatus in accordance with claim 2, wherein the means for presenting the vacuum heads of the respective coating separating means to the coatings on opposite sides of the matrix and the means for simultaneously retracting such vacuum heads from the matrix are constituted by two similar but opposite-acting reciprocating fluid motors actuated by a common source of fluid pressure.

4. Apparatus in accordance with claim 3, wherein each fluid motor has a piston rod, and comprising a vacuum manifold mounted on the opposite end of the piston rod, and a plurality of vacuum heads distributed over the vacuum manifold for simultaneous selective subjection to vacuum therefrom.

* * * * *